US006291934B1

(12) United States Patent
Berger et al.

(10) Patent No.: US 6,291,934 B1
(45) Date of Patent: Sep. 18, 2001

(54) HALOGEN INCANDESCENT LAMP HAVING U-SHAPED INNER SUPPLY LEAD HELD MECHANICALLY IN A FOLD IN THE FOIL

(75) Inventors: Helmut Berger, Lindlar; Hans Liermann, Kuerten; Reinhold Meier, Wipperfuerth, all of (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/267,810

(22) Filed: Mar. 12, 1999

(30) Foreign Application Priority Data

Mar. 20, 1998 (DE) ..... 198 12 379

(51) Int. Cl.[7] ..... H01J 17/18

(52) U.S. Cl. ..... 313/623; 313/318.07; 313/274; 313/318.02

(58) Field of Search ..... 313/274, 271, 313/278, 285, 623, 579, 625, 626, 331, 332, 318.02, 318.07

(56) References Cited

U.S. PATENT DOCUMENTS

| | | | | |
|---|---|---|---|---|
| 4,208,606 | * | 6/1980 | Newton | 313/274 |
| 5,140,217 | | 8/1992 | Rao et al. | 313/274 |
| 5,241,239 | * | 8/1993 | Rao | 313/318 |
| 5,932,955 | * | 8/1999 | Berger et al. | 313/318.02 |

FOREIGN PATENT DOCUMENTS

0780883A1 11/1996 (EP) .

* cited by examiner

*Primary Examiner*—Nimeshkumar D. Patel
*Assistant Examiner*—Karabi Guharay
(74) *Attorney, Agent, or Firm*—Carlo S. Bessone

(57) ABSTRACT

A supply lead (7) for a halogen incandescent lamp is bent in a U-shaped fashion and comprises a base (15) and two limbs (16). The ends of the limbs engage in the end region (6) of the luminous element by means of hook parts (20). A section (11) at the end, on the side of the luminous element, of the associated foil is folded back and forms a fold (12) in which the base (15) is held mechanically.

13 Claims, 4 Drawing Sheets

HALOGEN INCANDESCENT LAMP HAVING U-SHAPED INNER SUPPLY LEAD HELD MECHANICALLY IN A FOLD IN THE FOIL

TECHNICAL FIELD

The invention proceeds from a halogen incandescent lamp, in particular, an incandescent lamp which is pinched at two ends and has an axially arranged luminous element.

DESCRIPTION OF THE RELATED ART

Document EP-A 475 508 has already disclosed a generic halogen incandescent lamp. An end region of the cylindrical luminous element is held mechanically by a supply lead inserted therein, by virtue of the fact that the supply lead is bent asymmetrically in a plane. In detail, it is shaped such that a second limb with a free end is integrally formed on a first limb, aligned in an axially parallel fashion, of the supply lead. The free end hooks in at one side behind a turn of the luminous element which is at a distance from the end of the luminous element, while the first limb bears opposite the free end against the turns of the luminous element. The end, on the foil side, of the supply lead is welded to the foil in the usual way. The disadvantage of this design is that because of the asymmetrical shape of the supply lead, the centering of the luminous element and of the power supply system is not reliably ensured. Moreover, the welding operation is very time-consuming and costly.

SUMMARY OF THE INVENTION

It is the object of the present invention to provide a halogen incandescent lamp in accordance with the preamble of claim 1 which ensures good centering of the luminous element and whose production costs are nevertheless very low. A further object is also to provide a halogen incandescent lamp which is easy and quick to produce.

The present invention is based on a simply configured supply lead which is as symmetrically designed as possible and advantageously exerts a spring action on the luminous element and thus automatically ensures the centering of the luminous element. The concept of this supply lead has the particular advantage that the connection to the foil is not performed by welding, but by mechanical contact. As a result, not only are costs and the production period substantially lowered, but potential weak points are also eliminated. To date, it has been necessary to use an expensive platinum paste during welding. Moreover, the region of the spot weld has so far been subject to oxidation, which has shortened the service life.

In detail, the halogen incandescent lamp according to the invention has a hermetically sealed bulb which is made from transparent material and defines a lamp axis. Moreover, it has a coiled (and thus cylindrically shaped), preferably axially arranged, luminous element having two ends and a power supply system which is connected to the two end regions of the luminous element. The power supply system comprises a foil and an inner and outer supply lead, the inner end, on the side of the luminous element, of the supply lead holding the end region of the luminous element from inside. The outer end, on the foil side, of the supply lead is connected to the foil. The supply lead itself is bent in a U-shaped fashion by virtue of the fact that two free limbs, to which spring force is advantageously applied, lie in a plane and are interconnected via a straight base. The section, on the side of the luminous element, at the end of the associated foil is folded back and forms a fold in which the base is held mechanically. The ends of the free limbs project into an end region of the luminous element. At least one hook part on one of the free limbs projects outward. Said hook part engages between two turns of the luminous element.

The surface of the folded-over end section of the foil is normally rectangular. A rectangular end section, folded over in such a way, of the foil is already previously known from EP-A 780 883. However, this surface is now preferably reduced at at least one or even at both free corners. This facilitates the automatic suspension of the supply lead in the fold of the foil. Moreover, foil material is saved thereby. The folded-over section is preferably in the shape of a triangle (symmetrical or asymmetrical). However, it can also be shaped in a rounded off fashion, for example. This favorable configuration of the end section of the foil is independent in principle of the special way of providing a supply lead suspended in the foil. It is suitable in principle for both the outer and the inner supply leads. For this reason, protection is sought for this special shape of the folded-over end section with a reduced surface, independently of the special configuration of the supply lead suspended therein. This folded-over end section can also be used in principle in other types of lamp (in particular discharge lamps with a metal halide filling).

Each of the two limbs preferably has a hook part. This improves the holding, and the centering is even more effectively ensured.

The limbs are normally of equal length. However, for specific applications it is advantageous to use limbs of different lengths.

The concept of the invention is particularly well suited for a halogen incandescent lamp which is pinched at two ends, or else at one end. In this case, both end regions can be held by a novel supply lead.

The diameter of the wire which is used for the supply lead is advantageously at least as large as the spacing between two turns of the luminous element. In this way, holding is effected not only by the tensile stress between the two ends of the luminous element, but also, or chiefly, by a clamping engagement of the hook part between two turns of the luminous element. The wire diameter of the supply lead is preferably larger than the spacing between two turns of the luminous element, so that the filament is spread somewhat upon introduction of the supply lead; it is preferably 10 to 30% larger, so that the clamping engagement is easy to accomplish, on the one hand, and the holding force is nevertheless sufficiently reliable, on the other hand.

It is simplest for the hook part to be bent in the plane of the supply lead. However, it can also be bent outside this plane, it being possible for the two hook parts of the two limbs to point in opposite directions.

In order reliably to prevent the hook part from slipping out of the luminous element, the hook part preferably projects slightly outward beyond the luminous element.

The free limbs can run in a rectilinear and axially parallel fashion, and this is simplest to achieve. In another embodiment, the limbs are shaped such that the width of the foil can be selected independently of the dimensions of the luminous element. For this purpose, the limbs are either inclined inward toward the axis or, in a particularly preferred embodiment, a short distance before the end region of the luminous element, the two limbs have an inward curvature which reduces the spacing between the limb ends. This shape is ideally adapted to the end region of the luminous element, with the result that the holding and centering of the luminous element functions in a particularly reliable fashion.

The hook part preferably forms an outwardly projecting angle relative to the limb, the hook part being bent away at an angle $\alpha$ of between 30° and 120°, in particular approximately 50° to 60°, relative to the free limb.

In order to ensure reliable holding, the limbs are to be inserted at least as far as two turns, preferably more than three turns, into the end region of the luminous element.

The supply lead is mostly fabricated from tungsten or molybdenum.

It is to be noted that the hook part must be designed such that the width, on the side of the luminous element, is always smaller in the compressed state than the inside diameter of the luminous element. The length of the two hook parts (in the case of their being bent away at right angles) or their length in projection transverse to the lamp axis (in the case when the hook parts are arranged at an acute angle to the limbs) may therefore correspond at most to half the inside diameter of the cylinder formed by the luminous element. In the case of a single hook part, a length of up to the full inside diameter is therefore permissible.

A method for producing the above-described halogen incandescent lamp is based on the fact that the supply lead with the two limbs is firstly compressed. The supply lead is inserted in this state into the end region of the luminous element at least as far as two turns. Upon release of the supply lead, the limbs spring outward and press uniformly from inside against the end region of the luminous element. The hook part or parts press in a clamping fashion into the interspace between two turns. The tensioning of the filament is advantageous for this purpose, because it enlarges the spacing between two turns. Subsequently, a component comprising the foil and the external supply lead fastened thereon is fastened on the base of the inner supply lead. For this purpose, the section, on the side of the luminous element, of the foil is firstly bent away only by more than 90° (preferably at least 100°), so that a fold is produced in the foil. The inner supply lead is suspended with its base in the fold, and the luminous element is held under tensile stress with respect to the foil. Subsequently, the bent-away section of the foil is bent away further until it has described a bend of 180° overall. The tensile stress is further maintained for the transport to the further production steps (in particular pinching), so that the hook part cannot slip out of the fold in the foil. Pinching cheeks with an approximately central knob are preferably used in pinching the bulb end around the foil. The knob is raised with respect to the remainder of the pinch surface and has the effect that a large amount of bulb material (quartz glass preferably being used) is pressed between the limbs of the supply lead. The result of this is not only to ensure the supply lead is reliably held, but also that the foil remains centered in the middle of the pinch during the pinching operation itself.

The invention is preferably suitable for halogen incandescent lamps (tubular lamps) pinched at two ends. However, application is likewise possible for other lamps, for example for lamps pinched at one end.

BRIEF DESCRIPTION OF THE DRAWINGS

The invention is to be explained in more detail below with the aid of a plurality of exemplary embodiments. In the drawing.

DETAILED DESCRIPTION OF THE INVENTION

Figure 1:
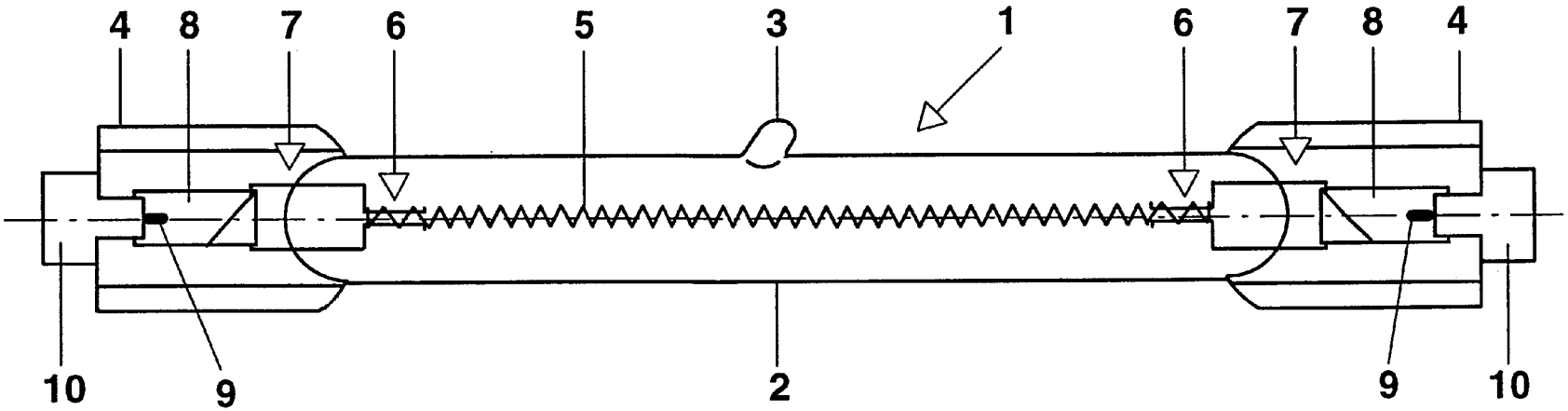
FIG. 1 shows a tubular lamp.

FIG. 1 shows a halogen incandescent lamp 1 which has a base and is pinched at two ends (tubular lamp) for general illumination with a power of 150 W. It is suitable for direct connection to the 230 V system, and has a cylindrical bulb 2 made from quartz glass. An exhaust tube 3 is provided in the middle. The two ends of the bulb are sealed in each case by a pinch seal 4. The bulb 2 is filled with argon to which a halogen additive known per se is added.

An axially arranged luminous element 5 with a luminous central section is singly coiled (or, in another exemplary embodiment, doubly coiled). The (primary) helix of the singly-coiled luminous element (or the secondary helix of the doubly-coiled luminous element) thereby forms a cylindrical body. The spacing between two turns is approximately 50 $\mu$m, with a wire diameter of approximately 190 $\mu$m. The luminous element 5 has an end region 6 of steep gradient at each end. There, the spacing between two turns is approximately 500 $\mu$m. The luminous element is connected via inner supply leads 7 to molybdenum foils 8 which are embedded in the pinch seals 4 at the ends of the bulb. Welded to the outer ends of the molybdenum foils are external electric supply leads 9 which are connected to contacts in the ceramic base 10.

Figure 2:
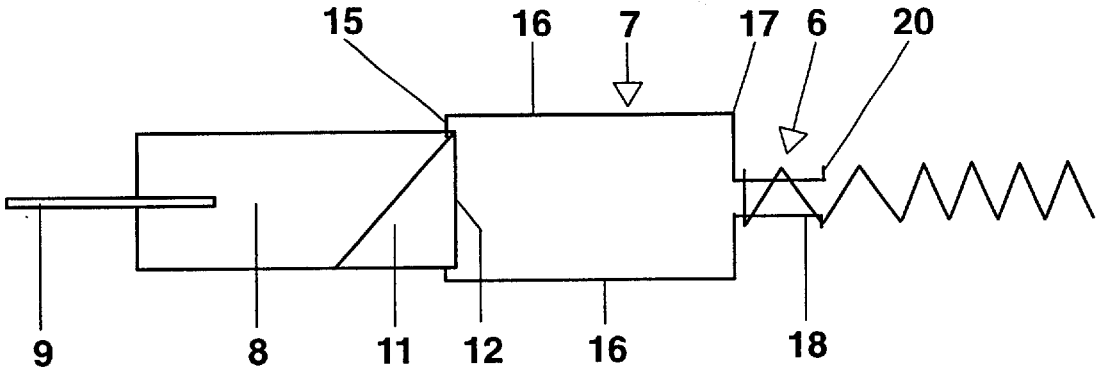
FIG. 2 shows an enlarged representation of the power supply system.

The power supply system is shown in more detail in FIG. 2. The end region 6 of the luminous element extends over a few turns (only one turn is shown, diagrammatically). The supply lead 7 made from tungsten and having a wire diameter of approximately 600 $\mu$m is bent approximately in a U-shaped fashion and has a straight base 15. It is suspended in a fold 12 in the foil, which is formed by folding back an end section 11 of the foil which is attached, on the side of the luminous element, to the foil 8 in the shape of a triangle arranged asymmetrically relative to the lamp axis. Starting at right angles at the base 15 of the supply lead are two resilient limbs 16 whose free ends 18 are bent away 17 inward and extend as far as into the interior of the end region 6 of the luminous element. A short distance before the end of the luminous element, the bent-away part 17 forms an inwardly directed crank 17, the free limb ends 18 bearing in each case on the inside against the turns of the end region 6. The limb ends 18 are advantageously bent slightly outward before insertion into the luminous element, with the result that in the installed state they still exert a certain spring force.

Approximately 1 mm, short hook parts 20 are bent outward approximately at right angles at the ends of the limb ends. They are clamped between two turns of the luminous element and project outward beyond the turns.

This design is suitable for powers of low wattage for which the luminous element is relatively small and unstable for electrical reasons.

Figure 3:
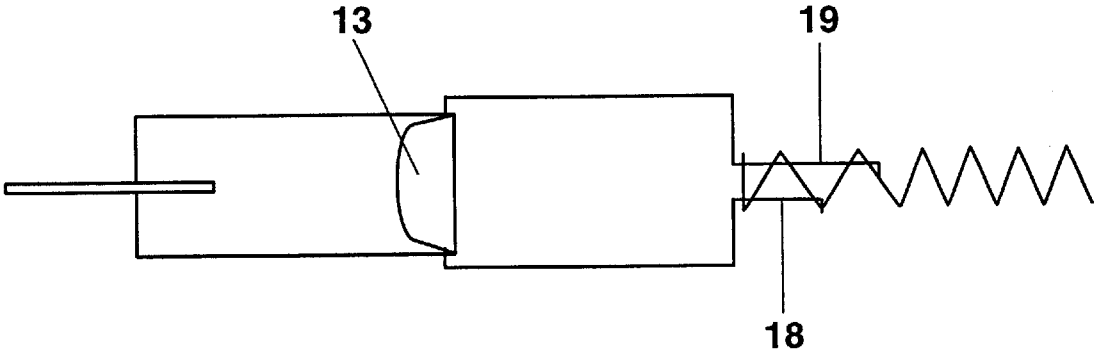
FIG. 3 shows a further exemplary embodiment of the power supply system.

In a further exemplary embodiment in accordance with FIG. 3, the first limb end 18 is formed with a hook end exactly as in FIG. 2. The second limb end 19 is, however, substantially longer than the first. It serves as a guiding aid. Its hook part is directed inward. The end section 13 of the foil is rounded off in this exemplary embodiment.

Figure 4:
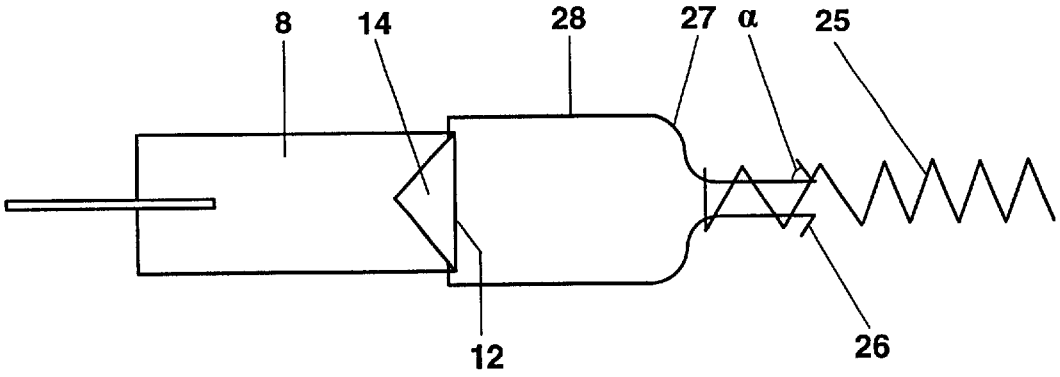
FIG. 4 shows a further exemplary embodiment of the power supply system.

In a further exemplary embodiment in accordance with FIG. 4, the luminous element 25 of a lamp of high wattage (500 W) is so stable that the hook parts 26, which are bent back acutely at an angle α of 45°, are already suspended after the second turn. The curvature 27 of the limbs 28 is more gently bent than in the first exemplary embodiment. This variant can preferably be applied when the supply lead has a relatively large diameter. The folded-over end section 14 has the shape of a triangle which is arranged symmetrically relative to the lamp axis.

Figure 5:
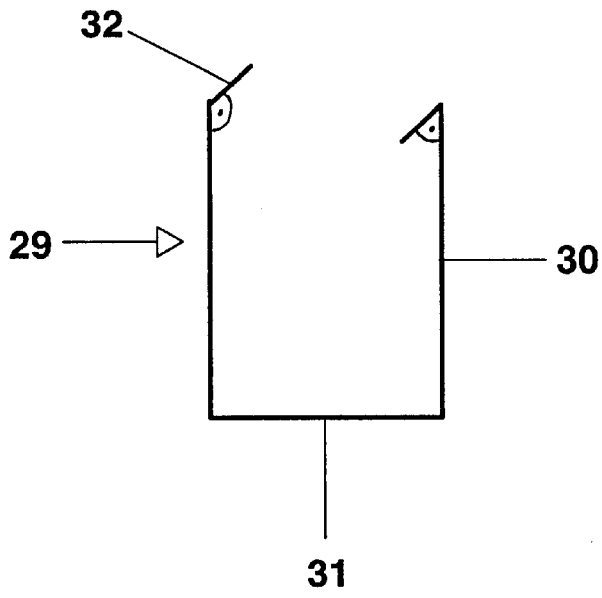
FIG. 5 shows a further exemplary embodiment of a supply lead.

In a further exemplary embodiment of a power supply system 29 in accordance with FIG. 5, the limbs 30 are attached at right angles on the base 31 and run parallel to one another. The hook parts 32 are bent away by 90° and project at right angles out of the plane of the limbs 30 in a fashion opposed to one another.

Figure 6:
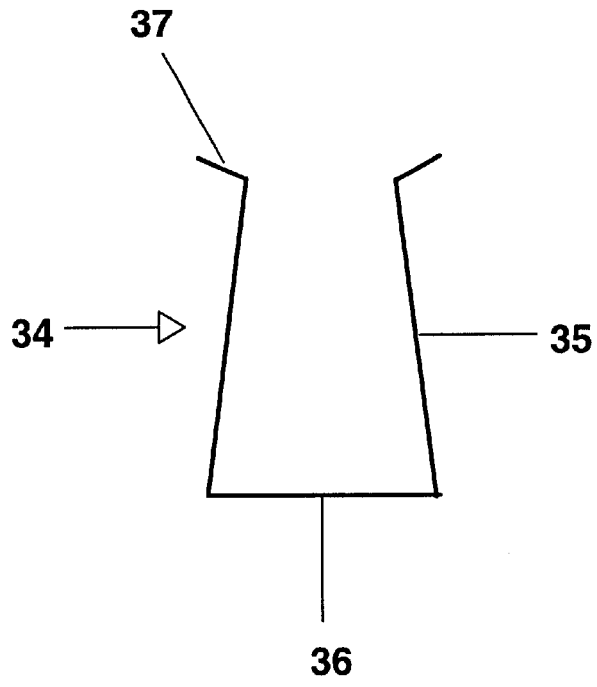
FIG. 6 shows a further exemplary embodiment of a supply lead.

In a further exemplary embodiment of a power supply system 34 in accordance with FIG. 6, the limbs 35 are attached at the base 36 in a fashion inclined obliquely inward. The hook parts 37 are bent away by 110° and remain in the plane of the system, which comprises the limb 35 and base 36.

Figure 7:
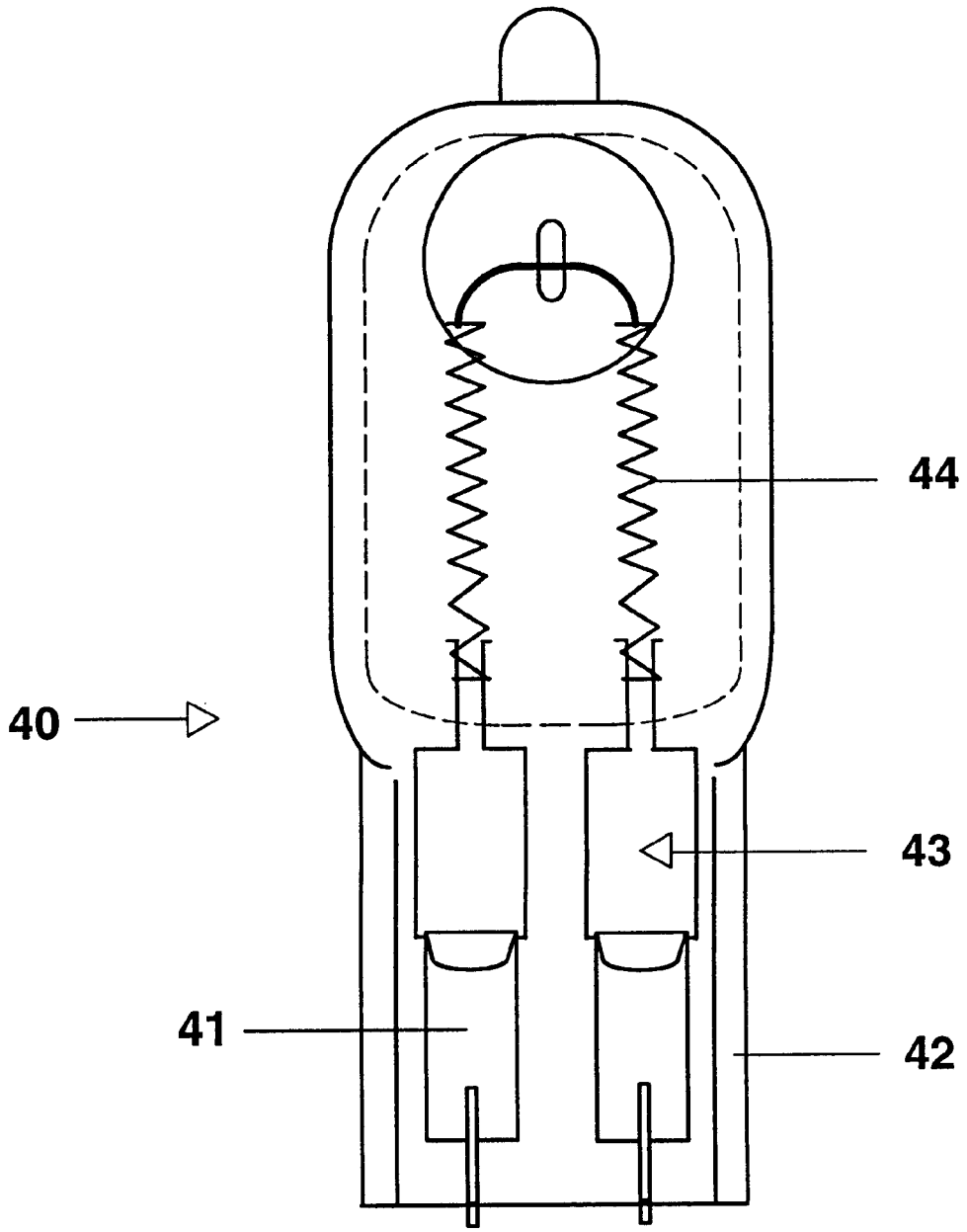
FIG. 7 shows an exemplary embodiment of a halogen incandescent lamp pinched at one end.

Shown in FIG. 7 is a halogen incandescent lamp 40 which is pinched at one end and whose two molybdenum foils 41 are embedded parallel to one another in a single pinch 42. Two inner supply leads 43 are designed in a fashion similar to that described in FIG. 2 and hold the ends of a luminous element 44 bent in a U-shaped fashion.

What is claimed is:

1. A halogen incandescent lamp having a hermetically sealed bulb (2) which is made from transparent material and defines a lamp axis, having a coiled luminous element (5) which forms a cylinder and has two end regions (6), and having a power supply system which is connected to the two end regions (6) of the luminous element, the power supply system comprising foils (8) and supply leads (7), the inner end, on the side of the luminous element, of the supply lead holding the end region (6) of the luminous element from inside, and the outer end, on the foil side, of the supply lead being connected to the foil (8), wherein the supply lead (7) is bent in a U-shaped fashion by interconnecting two free limbs (16), which lie in a plane, via a straight base (15), a section (11) at the end, on the side of the luminous element, of the associated foil being folded back and forming a fold (12) in which the base (15) is held mechanically, the ends (18) of the limbs (16) projecting into the end region (6) of the luminous element, and at least one hook part (20) projecting outward at one of the limb ends which engages between two turns of the luminous element.

2. The halogen incandescent lamp as claimed in claim 1, wherein each of the two limb ends (18) has a hook part (20).

3. The halogen incandescent lamp as claimed in claim 1, wherein the halogen incandescent lamp (1;40) is pinched at two ends or at one end.

4. The halogen incandescent lamp as claimed in claim 1, wherein the diameter of the wire of the supply lead (7) is at least as large as, preferably 10 to 30% larger than, the spacing between two turns of the luminous element in the region where the hook parts engage.

5. The halogen incandescent lamp as claimed in claim 1, wherein the hook part (20) is bent in the plane of the supply lead.

6. The halogen incandescent lamp as claimed in claim 1, wherein the hook part (20) projects outward beyond the luminous element.

7. The halogen incandescent lamp as claimed in claim 1, wherein the free limbs are axially parallel or run in a fashion inclined rectilinearly inward, toward the axis, or have a curvature (17;27) which reduces the spacing between them.

8. The halogen incandescent lamp as claimed in claim 1, wherein the hook part is bent away at an angle α of between 30° and 120°, in particular approximately 50° to 60°, relative to the limb end.

9. The halogen incandescent lamp as claimed in claim 1, wherein the limb ends are inserted at least as far as two turns into the end region (6) of the luminous element.

10. The halogen incandescent lamp as claimed in claim 1, wherein at least one of its two free corners, the folded-over section (11) of the foil is shaped like a triangle or rounded off.

11. A method for producing a halogen incandescent lamp as claimed in claim 1, wherein the supply lead with the two limbs is firstly compressed and inserted into the end region of the luminous element at least as far as two turns and is then released such that upon release the limbs press outward and bear uniformly from inside against the end region of the luminous element, while the hook parts press inward in a clamping fashion into the interspace between two turns.

12. The method as claimed in claim 11, wherein the end section, on the side of the luminous element, of the foil is firstly bent away only by more than 90° (preferably at least 100°), so that a fold is produced in the foil and the supply lead is suspended with its base in the fold, and subsequently the bent-away section of the foil is completely bent away so that it experiences a bend of 180° overall.

13. An electric lamp having a hermetically sealed bulb (2) which is made from transparent material and defines a lamp axis, luminous means (5), which has two end regions (6) and a power supply system which is connected to the two end regions (6) of the luminous means, the power supply system comprising foils (8) and inner and outer supply leads (7;9), and the inner end, on the side of the luminous element, of the inner supply lead holding the luminous element, and the outer end, on the foil side, of the inner supply lead being connected, just like the outer supply lead (9), to the foil (8), and at least one section (11) being folded back at one end of the foil and forming a fold (12), and at least one of the supply leads being held mechanically in this at least one fold (12), wherein at least one of its two free corners, the folded-over section (11) of the foil is shaped like a triangle or rounded off.

* * * * *